US007798278B2

(12) United States Patent
Tesinsky

(10) Patent No.: US 7,798,278 B2
(45) Date of Patent: Sep. 21, 2010

(54) REMOTE CONTROL FOR SHIFTING THE GEARS OF A SNOWPLOW TRUCK TRANSMISSION

(76) Inventor: Vincent E. Tesinsky, 1423 County Rd. 30, Weston, NE (US) 68070

( * ) Notice: Subject to any disclaimer, the term of this patent is extended or adjusted under 35 U.S.C. 154(b) by 372 days.

(21) Appl. No.: 12/075,498

(22) Filed: Mar. 12, 2008

(65) Prior Publication Data

US 2009/0229149 A1 Sep. 17, 2009

(51) Int. Cl.
*B60K 23/00* (2006.01)
*E01H 5/04* (2006.01)

(52) U.S. Cl. ..... 180/333; 180/336; 37/234

(58) Field of Classification Search ..... 180/321, 180/324, 333, 336; 37/234, 382; 74/473.12
See application file for complete search history.

(56) References Cited

U.S. PATENT DOCUMENTS 3,098,543 A * 7/1963 Hastings, Jr. ..... 187/224
4,831,752 A * 5/1989 Clevenger ..... 37/234
4,884,057 A * 11/1989 Leorat ..... 340/456
5,042,314 A * 8/1991 Rytter et al. ..... 74/335
5,335,743 A * 8/1994 Gillbrand et al. ..... 180/178
5,361,519 A * 11/1994 Ciula et al. ..... 37/234
5,365,803 A * 11/1994 Kelley et al. ..... 74/484 R
5,566,586 A * 10/1996 Lauer et al. ..... 74/523
H001831 H * 2/2000 Kelley et al. ..... 180/333
6,152,239 A * 11/2000 Kelley et al. ..... 172/4.5
6,152,676 A * 11/2000 Evert et al. ..... 414/631
6,163,985 A 12/2000 Chinnery et al.
6,354,023 B1 * 3/2002 Trahan et al. ..... 37/219
6,852,934 B1 * 2/2005 Lashua ..... 200/5 R
7,275,616 B2 * 10/2007 Link et al. ..... 180/333
7,349,772 B2 * 3/2008 Delaney et al. ..... 701/2
7,497,298 B2 * 3/2009 Shearer et al. ..... 180/333
7,641,021 B2 * 1/2010 Behncke et al. ..... 180/333
7,681,340 B2 * 3/2010 Treuthardt ..... 37/348
2002/0166267 A1 * 11/2002 McGugan ..... 37/348

OTHER PUBLICATIONS

SPAL Linear Acutator Controller LA-Controller, Installation Manual & Operation Instructions Nov. 2004, www.spalusa.com.

* cited by examiner

*Primary Examiner*—Paul N Dickson
*Assistant Examiner*—Laura Freedman
(74) *Attorney, Agent, or Firm*—Dennis L. Thomte; Thomte Patent Law Office LLC

(57) ABSTRACT

A remote control for shifting the gears of a snowplow truck automatic transmission with the remote control being positioned adjacent the remote controller for the truck's snowplow. The driver of the snowplow vehicle may steer the vehicle with his/her left hand and will have the remote controller for the truck snowplow and the remote controller for shifting the gears of the snowplow truck in his/her right hand which eliminates the need for the gear shift of the vehicle to be manually manipulated at the beginning or end of forward or rearward snowplow runs.

12 Claims, 5 Drawing Sheets

REMOTE CONTROL FOR SHIFTING THE GEARS OF A SNOWPLOW TRUCK TRANSMISSION

BACKGROUND OF THE INVENTION

1. Field of the Invention

This invention relates to a remote control for shifting the gears of a snowplow truck transmission and more particularly to a remote control for shifting the gears of a snowplow truck transmission which is attached to one side of a remote snowplow controller, which controls the movement of the blade of the snowplow.

2. Background of the Invention

Commercial snowplows are usually mounted at the front end of a truck and include a snowplow blade which may be raised, lowered, angled toward the left side of the truck or angled toward the right side of the truck. Many types of snowplow controllers have been employed such as those marketed by Monroe Electro-Hydraulics Plow Control Systems, Force America, Maddock Grader Stick, etc. Some of the controllers for the snowplows are radio controlled while others are hard wired. In most cases, the controller is about the size of a garage door opener and has push buttons or a joystick or both to enable the driver to remotely control the various movements of the snowplow. Normally, the driver will grasp the truck steering wheel with his/her left hand to steer the vehicle and will have his/her right hand grasping the controller for the snowplow. When the snowplow reaches the end of a forward push, the driver must then raise the snowplow blade and then shift the truck into reverse gear, which is difficult since the driver must attempt to shift the vehicle into reverse with his/her right hand which is holding the controller for the snowplow, or reach across the steering wheel with his/her left hand to move the shift lever. When the snowplow reaches its back-up position, the above procedure is again necessary to lower the blade of the snowplow and to shift the truck into a forward gear.

The above procedures are wearing upon the snowplow driver, especially those who perform many snowplow removing operations over a period of several hours.

SUMMARY OF THE INVENTION

A remote control for shifting the gears of a snowplow truck transmission so that the remote control may be used in combination with a remote controller for the snowplow. The vehicle to which the snowplow is attached includes a cab and an automatic transmission. The snowplow is mounted on the vehicle and is adapted to be at least raised and lowered with respect to the vehicle and in many cases the snowplow may be angled toward the left side of the vehicle or to the right side of the vehicle. A first electronic controller is positioned in the cab of the vehicle and is operatively connected to the snowplow to enable the vehicle driver to raise and lower the snowplow. An actuator such as a lineator actuator is operatively connected to the automatic transmission and is adapted to shift the automatic transmission between gears. A second electronic controller is provided in the cab and is operatively coupled to the actuator to enable the vehicle driver to remotely shift the gears of the automatic transmission. In the preferred embodiment, the actuator comprises a lineator actuator which is operatively, pivotally connected to a shifting lever extending from the automatic transmission of the vehicle. The first electronic controller is contained within a first hand-held housing and the second electronic controller is positioned within a second hand-held housing with the two housings being joined together so that the driver of the snowplow vehicle may grasp the two controller housings in one hand and to shift the transmission gears between forward and reverse gears with the same hand while controlling the steering of the vehicle with the driver's left hand. Although the first and second electronic controllers are illustrated as being in individual housings, it is contemplated that both the controllers could be located within a single housing.

It is therefore a principal object of the invention to provide a remote control for shifting the gears of a snowplow truck transmission.

A further object of the invention is to provide a snowplow controller/remote transmission shifter.

Still another object of the invention is to provide a means for a snowplow driver to control the operation of the snowplow blade as well as shifting the vehicle transmission between reverse and forward gears with a single hand while steering the vehicle with the driver's other hand.

Yet another object of the invention is to provide a linear actuator for operating the automatic transmission of a snowplow vehicle which does not require extensive modification of the vehicle or the transmission.

These and other objects will be apparent to those skilled in the art.

DESCRIPTION OF THE PREFERRED EMBODIMENT

Figure 1:
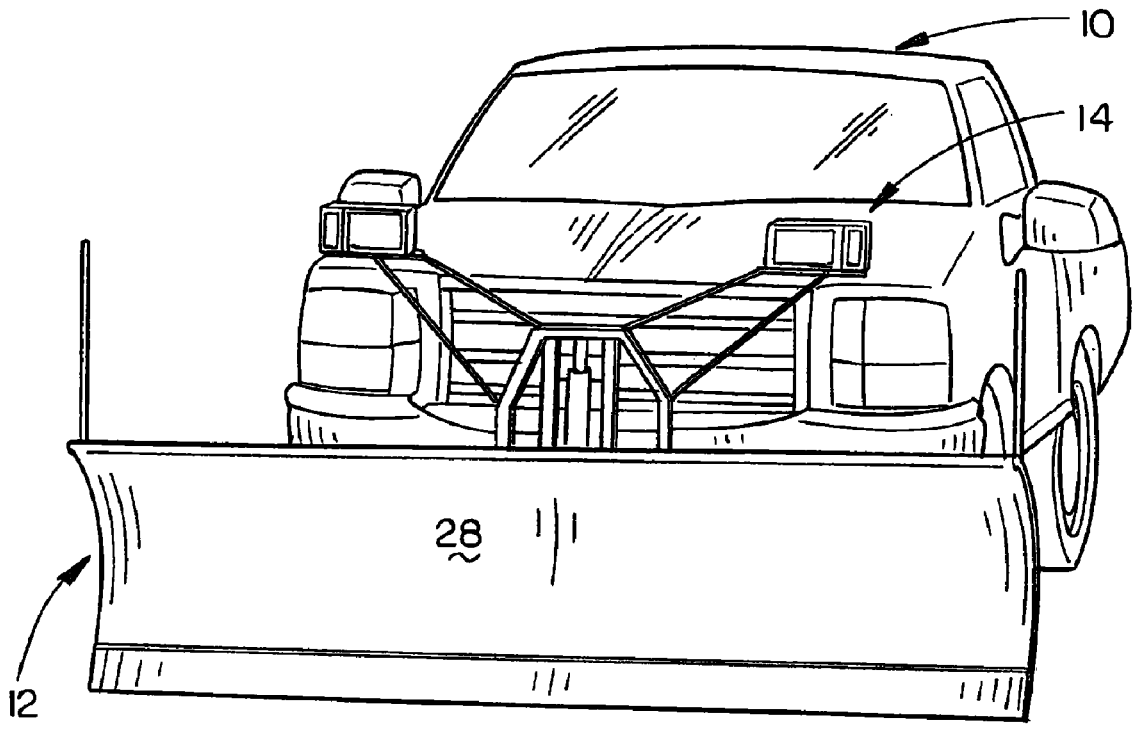
FIG. 1 is a front perspective view of a snowplow mounted on a vehicle such as a truck.
Figure 2:
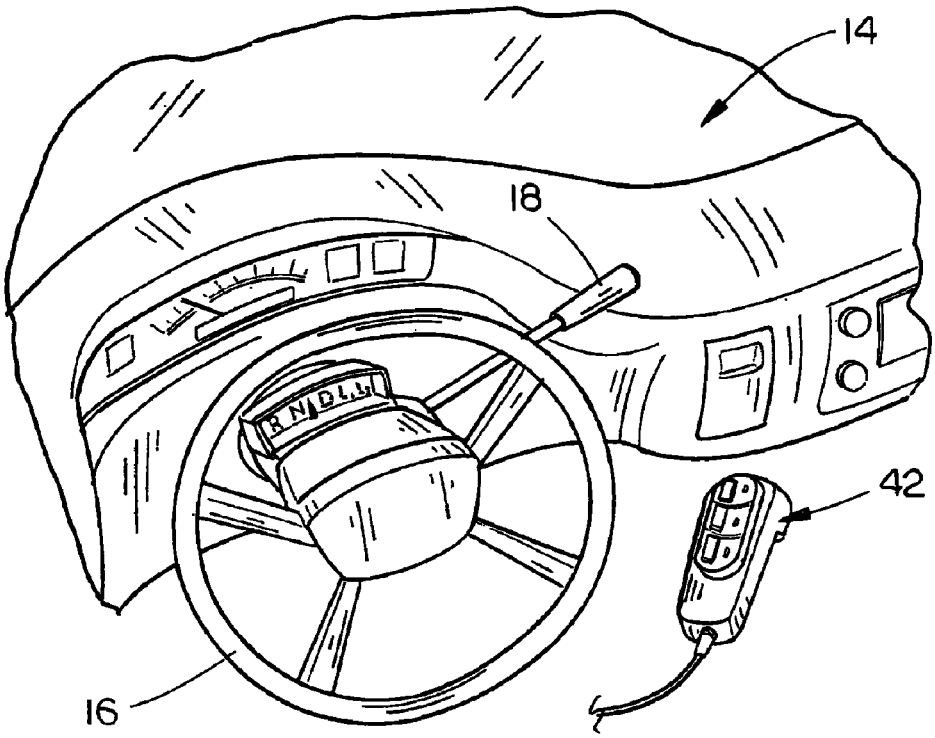
FIG. 2 is a perspective view of the inside of the cab of the truck of 1 illustrating the remote controller of this invention located within the cab of the vehicle.
Figure 3:
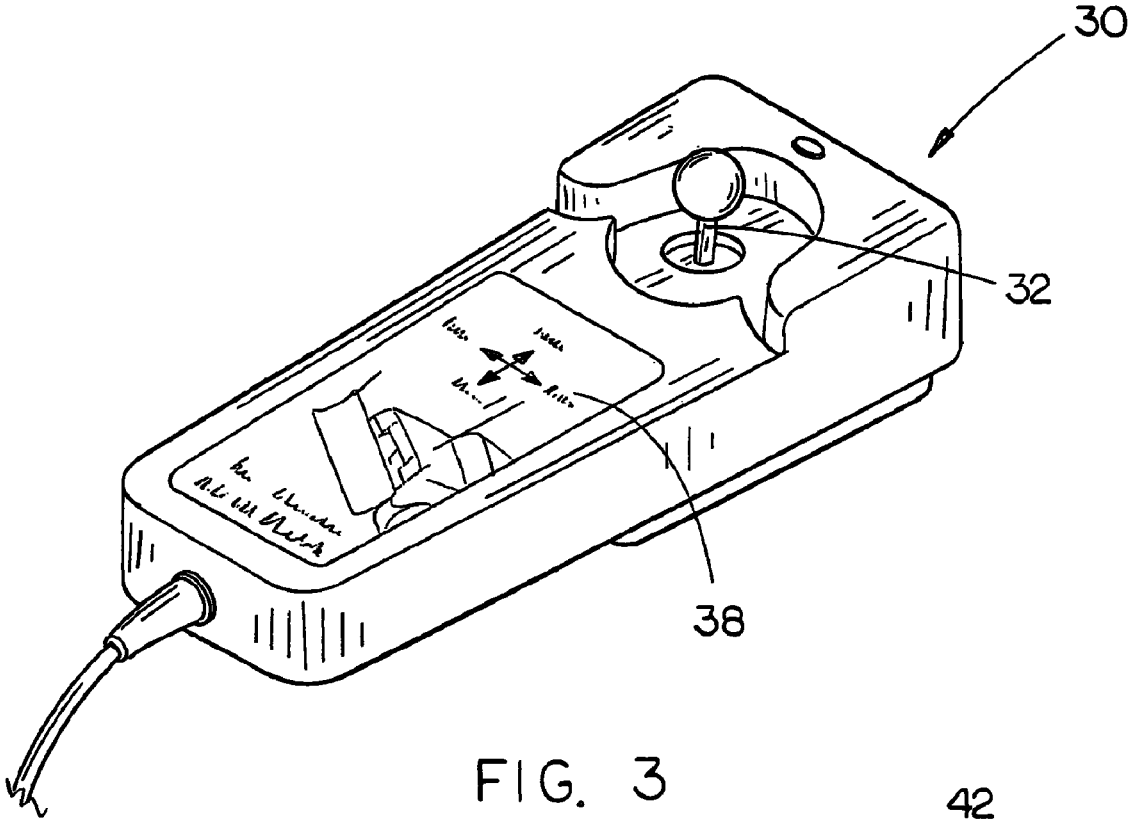
FIG. 3 is a top perspective view of a conventional snowplow controller having the transmission controller of this invention mounted on the underside thereof.
Figure 4:
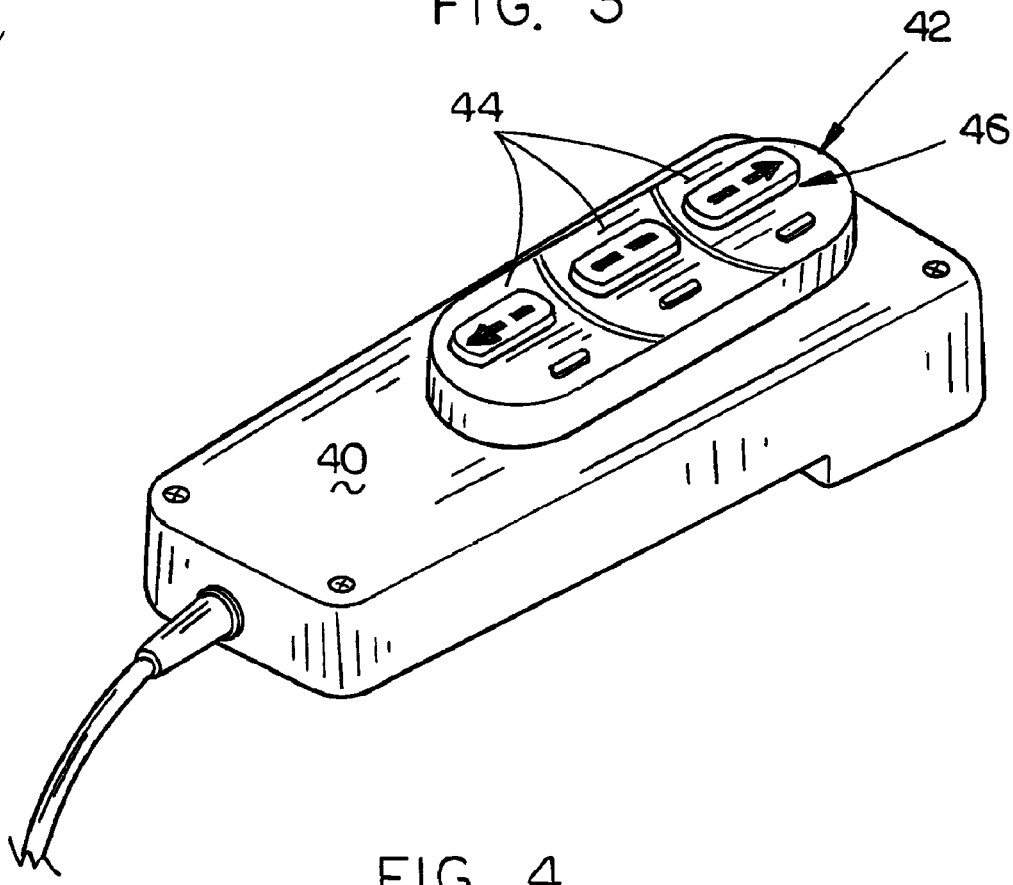
FIG. 4 is a bottom perspective view of controllers of 3 which illustrates the controller for controlling the transmission of the vehicle mounted on the back side of the controller for operating the controls of the snowplow.
Figure 5:
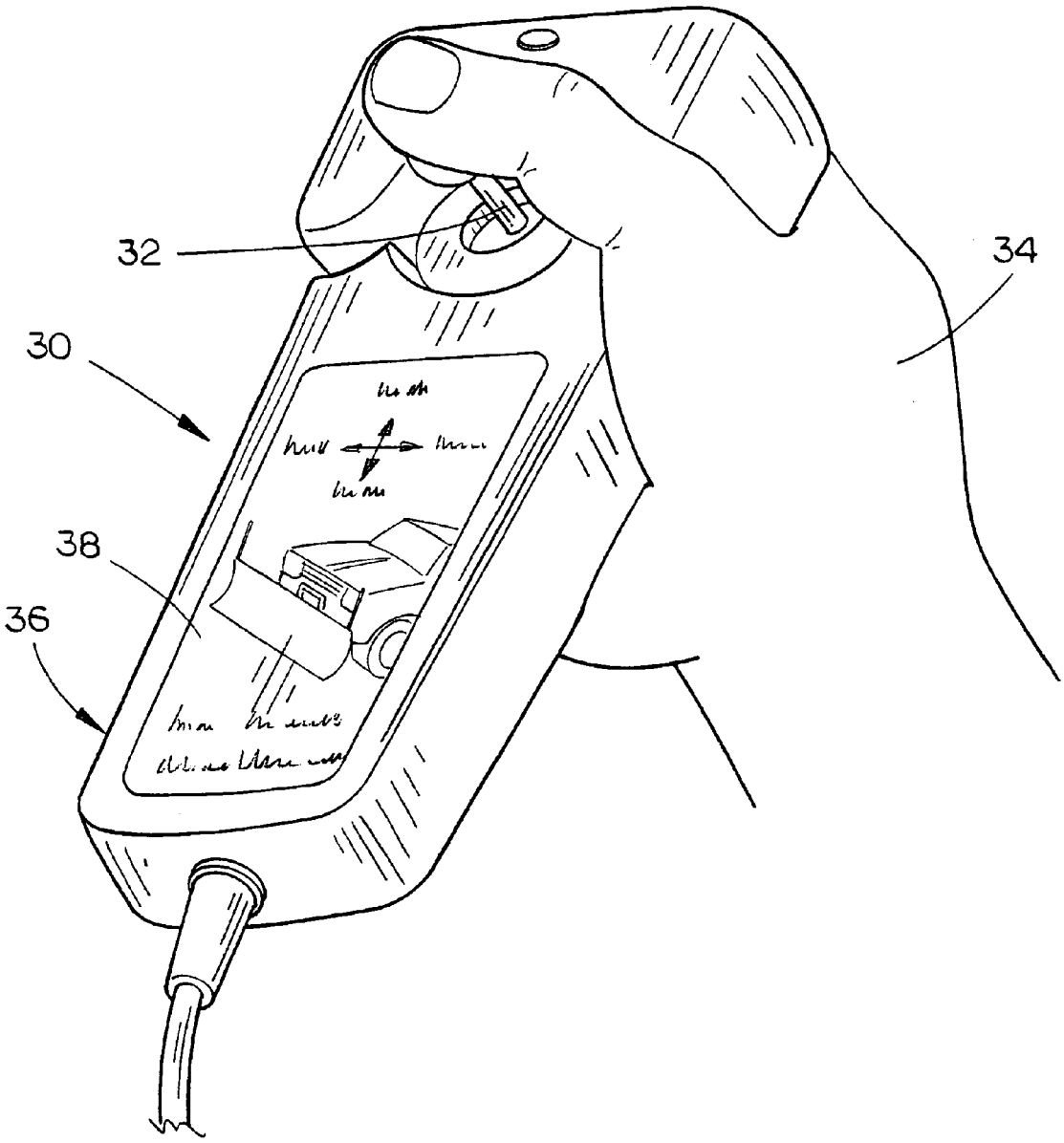
FIG. 5 is a perspective view illustrating the manner in which the two electronic controllers for controlling the operation of the snowplow and the vehicle transmission are held by one hand of the vehicle driver.
Figure 6:
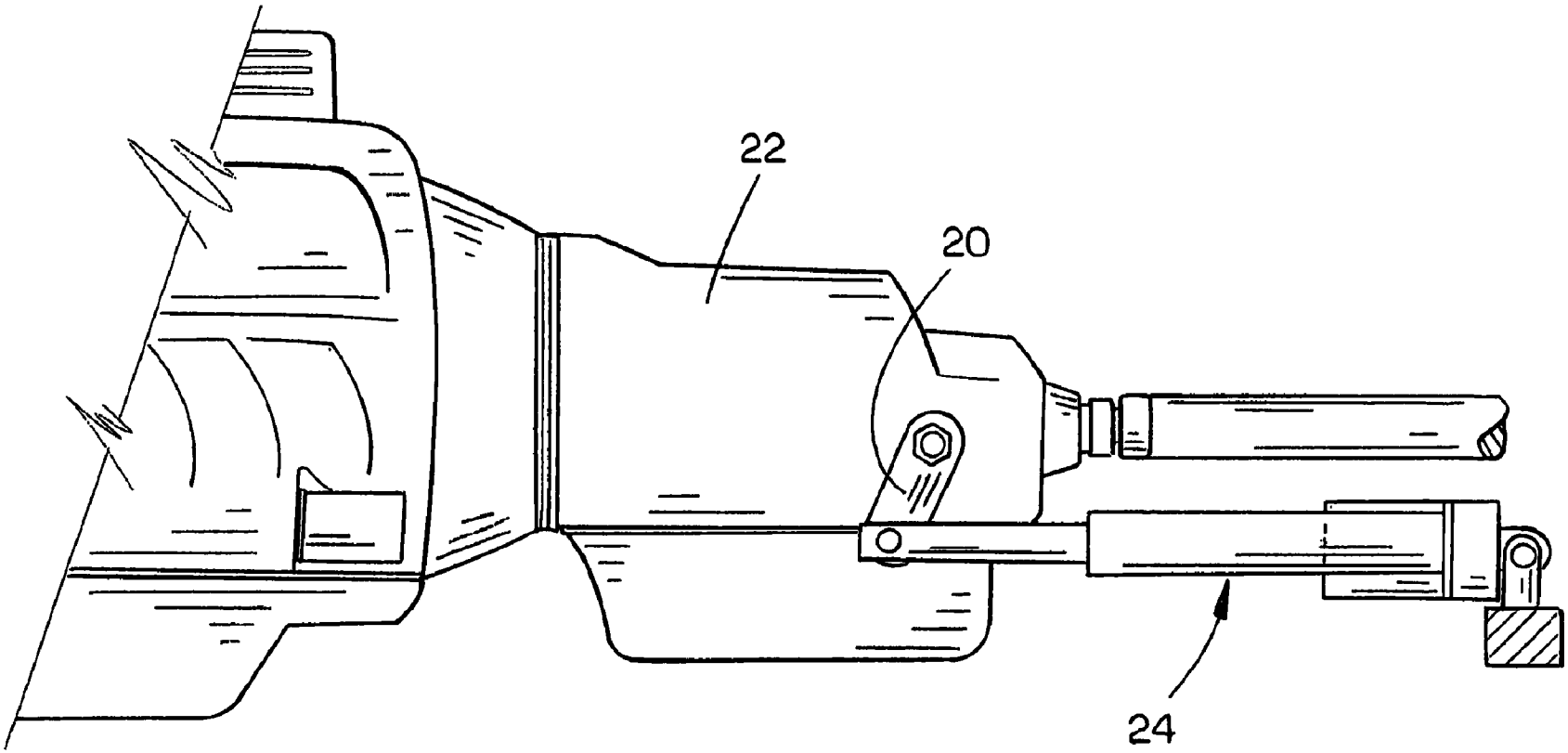
FIG. 6 is a side view illustrating the linear actuator of this invention operatively connected to the transmission of the vehicle to which the snowplow is connected.
Figure 7:
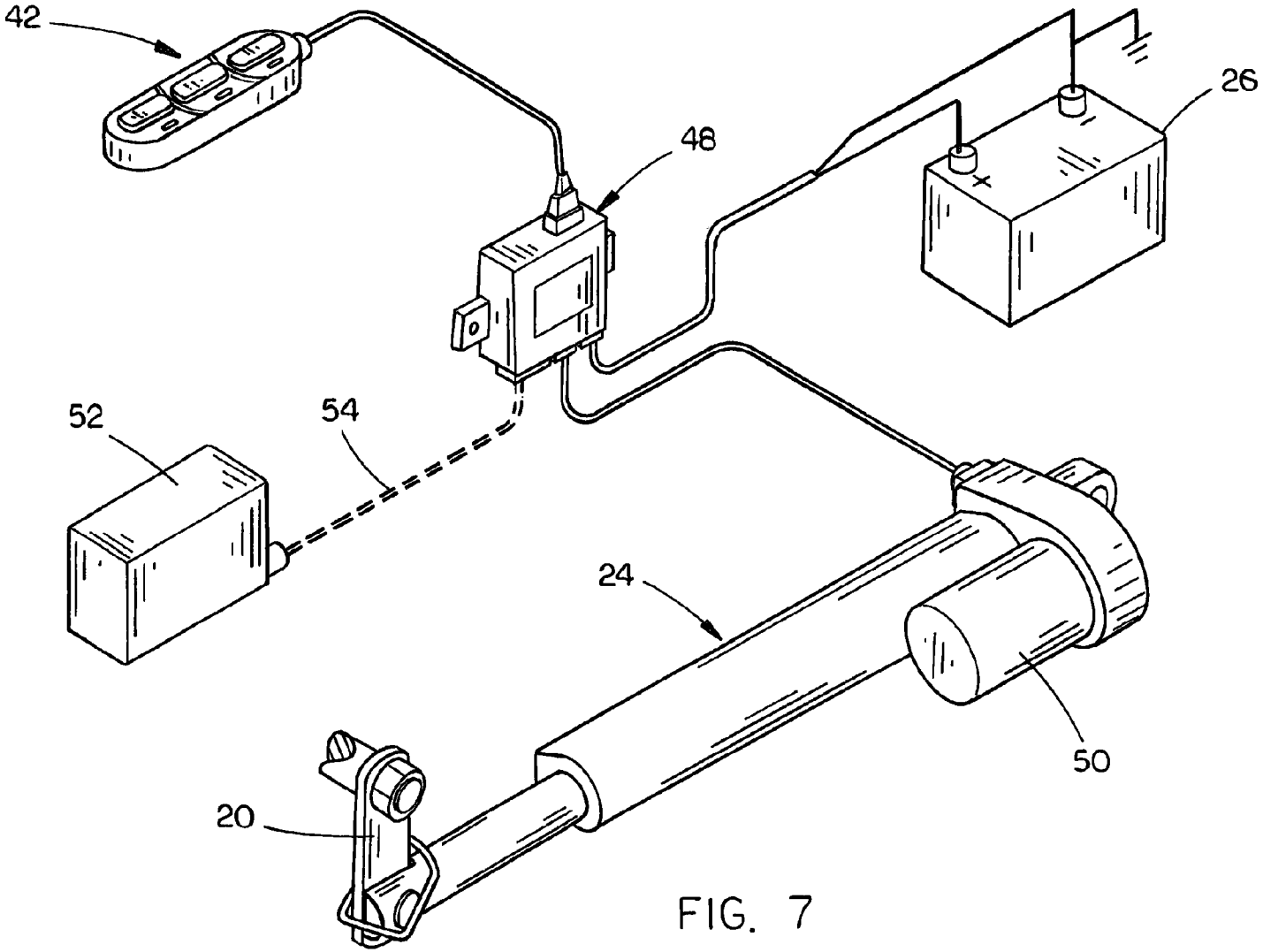
FIG. 7 is a schematic of the remote controller circuitry for shifting the transmission of the snowplow vehicle.

In 1, the numeral 10 refers to a vehicle such as a truck or the like which has a conventional snowplow 12 mounted at the forward end thereof and which normally is able to be raised, lowered and angled from side to side to facilitate snowplow operations. Vehicle 10 includes a cab 14 which includes a conventional steering wheel and an automatic transmission shift lever 18. Shift lever 18 is normally connected to a shift lever 20 which is positioned at one side of the vehicle automatic transmission 22 so that the shift lever 18 may pivotally move the shift lever 20 to shift the automatic transmission 22 between its various gears. Normally, the shift lever 20 has a linkage secured thereto which causes the pivotal movement of the shifting lever 20. The conventional linkage is removed in this invention and a linear actuator 24 is substituted therefore as will be described in more detail hereinafter. The vehicle 10 also includes a conventional battery 26 which is electrically connected to the linear actuator 24 as seen in 7.

Normally, the snowplow blade may be raised or lowered and angled from side to side by conventional linear actuators or hydraulic cylinders. The movement of the snowplow blade 28 is normally controlled by a conventional electronic controller 30 which may include push buttons or a toggle member 32 or both. Normally, the driver of the vehicle will manipulate the steering wheel 16 with his/her left hand and will grasp the controller 30 in his/her right hand 34. For purposes of description, the electronic controller 30 will be described as including a housing 36 having a front face 38 and a back side 40. The controller 30 may be radio controlled or may be hard wired to the mechanism which operates the various functions of the blade 28 of the snowplow 12.

The linear actuator 24 which replaces the conventional mechanical linkage connected to the lever 20 and the gear shift 18 is of the type marketed by Spal USA and is identified as LA-Controller. The electronic controller of this invention for controlling the linear actuator 24 is referred to generally by the reference numeral 42 and includes-push buttons 44 which shift the automatic transmission 22 into park, reverse and drive. The electronic controller 42 is enclosed within a housing 46, which is mounted on the back side 40 of the electronic controller 30. The electronic controller 42 may be hard wired or radio controlled to a central control unit 48, which is electrically connected to the motor 50 of the linear actuator 24 which is pivotally connected to the shift lever 20. Battery 26 is operatively electrically connected to the control unit 48 to provide the necessary power to the controller 42 and the linear actuator 24. Although the linear actuator 24 is the preferred component for pivotally moving the shift lever 20, other types of actuators may be used if so desired. The circuitry for the linear actuator 24 and the controller 42 may also include a vehicle speed sensor 52 for prohibiting gear changes if vehicle movement is detected. Speed sensor 52 is electronically connected to central control unit 48 by lead or leads 54.

In use, the driver will normally hold the actuator 30 and 42 which are connected together, or which may be in a single housing, with his/her right hand so that the driver may steer the vehicle with his/her left hand and will be able to not only control the operation of the snowplow through the electronic controller 30 but will also be able to control the automatic transmission of the vehicle by way of the controller 42. Thus, the driver in the forward push mode will have the snowplow blade in its lowered position and will have the automatic transmission in its drive condition. When the driver has reached the end of the forward push task, the driver does not have to attempt to move the shift lever with either his/her right hand which normally would have the controller 30 therein or his/her left hand by reaching across the steering wheel but simply raises the blade of the snowplow by way of the electronic actuator 30 and shifts the automatic transmission into its reverse position by simply depressing one of the push buttons on the controller 42. In other words, the operator may control the joy stick or push buttons on the electronic controller 30 with his/her thumb and can control the push buttons on the electronic controller 42 with his/her fingers which are wrapped around the combined unit and which will be in position adjacent the push buttons of the electronic controller 42.

Thus, it can be seen that a novel apparatus has been provided for enabling the driver of a snowplow vehicle to shift the vehicle automatic transmission between its various gears with the same hand that is simultaneously or sequentially operating the blade of the snowplow. It can therefore be seen that the invention accomplishes at least all of its stated objectives.

The invention claimed is:

1. In combination:

a vehicle including a cab and an automatic transmission;

a snowplow mounted on said vehicle which is adapted to be at least raised and lowered with respect to the vehicle;

a first electronic controller in said cab operatively connected to said snowplow to enable a vehicle driver to raise and lower said snowplow;

an actuator operatively coupled to said automatic transmission which is adapted to shift said automatic transmission between gears;

and a second electronic controller in said cab operatively coupled to said actuator to enable a vehicle driver to remotely shift the gears of said automatic transmission;

said actuator comprising a linear actuator.

2. The combination of claim 1 wherein said linear actuator is electronically operated.

3. The combination of claim 1 wherein said first electronic controller includes a control face and a back side and wherein said second electronic controller is mounted on said back side of said first electronic controller.

4. The combination of claim 3 wherein a vehicle driver may grasp the first and second electronic controllers in one hand and control the functions of said first and second electronic controllers with that one hand.

5. The combination of claim 1 wherein said automatic transmission has a pivotal shifting lever extending therefrom and wherein said linear actuator is connected to said pivotal shifting lever to move said pivotal shifting lever between various shifting positions.

6. In combination:

a vehicle including a cab and an automatic transmission;

a snowplow mounted on said vehicle which is adapted to be at least raised and lowered with respect to the vehicle;

a first electronic controller in said cab operatively connected to said snowplow to enable a vehicle driver to raise and lower said snowplow;

an actuator operatively coupled to said automatic transmission which is adapted to shift said automatic transmission between gears;

and a second electronic controller in said cab operatively coupled to said actuator to enable a vehicle driver to remotely shift the gears of said automatic transmission;

said first electronic controller being contained within a first hand-held housing;

said second electronic controller being contained within a second hand-held housing;

said first and second housings being operatively secured together so that a vehicle driver may hold and control both of said housings with one hand.

7. In combination with a vehicle including a cab and automatic transmission with the vehicle having a snowplow mounted thereon which is adapted to be at least raised and lowered with respect to the vehicle comprising:

a first electronic controller in said cab operatively connected to said snowplow to enable a vehicle driver to raise and lower said snowplow;

an actuator operatively coupled to said automatic transmission which is adapted to shift said automatic transmission between gears;

and a second electronic controller in said cab operatively coupled to said actuator to enable a vehicle driver to remotely shift the gears of said automatic transmission;

said actuator comprising a linear actuator.

8. The combination of claim 7 wherein said linear actuator is electronically operated.

9. The combination of claim 7 wherein said first electronic controller includes a control face and a back side and wherein said second electronic controller is mounted on said back side of said first electronic controller.

10. The combination of claim 9 wherein a vehicle driver may grasp the first and second electronic controllers in one hand and control the functions of said first and second electronic controllers with that one hand.

11. The combination of claim 7 wherein said automatic transmission has a pivotal shifting extending therefrom and wherein said linear actuator is connected to said pivotal shifting lever to move said pivotal shifting lever between various shifting positions.

12. In combination with a vehicle including a cab and automatic transmission with the vehicle having a snowplow mounted thereon which is adapted to be at least raised and lowered with respect to the vehicle comprising:

a first electronic controller in said cab operatively connected to said snowplow to enable a vehicle driver to raise and lower said snowplow;

an actuator operatively coupled to said automatic transmission which is adapted to shift said automatic transmission between gears;

and a second electronic controller in said cab operatively coupled to said actuator to enable a vehicle driver to remotely shift the gears of said automatic transmission;

said first electronic controller being contained within a first hand-held housing;

said second electronic controller being contained within a second hand-held housing;

said first and second housings being operatively secured together so that a vehicle driver may hold and control both of said housings with one hand.

* * * * *